US007981358B2

(12) United States Patent
Yamamoto et al.

(10) Patent No.: US 7,981,358 B2
(45) Date of Patent: Jul. 19, 2011

(54) COOLING APPARATUS OF HOT STEEL PLATE, COOLING METHOD OF HOT STEEL PLATE, AND PROGRAM

(75) Inventors: Ryuji Yamamoto, Tokyo (JP); Yoshihiro Serizawa, Tokyo (JP); Shigeru Ogawa, Tokyo (JP); Hironori Ueno, Tokyo (JP); Masahiro Doki, Tokyo (JP); Yasuhiro Nishiyama, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 397 days.

(21) Appl. No.: 12/086,728

(22) PCT Filed: Jul. 30, 2007

(86) PCT No.: PCT/JP2007/065307

§ 371 (c)(1),
(2), (4) Date: Jun. 18, 2008

(87) PCT Pub. No.: WO2009/016767

PCT Pub. Date: Feb. 5, 2009

(65) Prior Publication Data

US 2010/0219565 A1 Sep. 2, 2010

(51) Int. Cl.
*C21B 7/16* (2006.01)

(52) U.S. Cl. ..... 266/47; 266/113; 266/130

(58) Field of Classification Search ..... 266/47, 266/113, 130

See application file for complete search history.

(56) References Cited

U.S. PATENT DOCUMENTS

| | | | | |
|---|---|---|---|---|
| 4,132,393 | A * | 1/1979 | Nakamura et al. | 266/117 |
| 6,866,729 | B2 * | 3/2005 | Gramckow et al. | 148/511 |
| 2001/0000377 | A1 * | 4/2001 | Matsuda et al. | 266/113 |

FOREIGN PATENT DOCUMENTS

| | | |
|---|---|---|
| JP | 06-238320 | 8/1994 |
| JP | 07-157826 | 6/1995 |
| JP | 10-216821 | 8/1998 |
| JP | 10-291019 | 11/1998 |
| JP | 2005-279691 | 10/2005 |
| JP | 2006-105792 | 4/2006 |
| JP | 2006-110611 | 4/2006 |
| JP | 2007105792 | 4/2007 |

OTHER PUBLICATIONS

"The relationship between impinging jet pressure and cooling rate in the water cooling" CAMP-ISIJ vol. 18(2005) No. 2, p. 418.

* cited by examiner

*Primary Examiner* — Scott Kastler
(74) *Attorney, Agent, or Firm* — Kenyon & Kenyon LLP

(57) ABSTRACT

An apparatus for controlled cooling of hot steel plate while constraining and conveying the plate by constraining rolls horizontally which is inexpensive and enabling continuous control of the cooling ability over a broad range, that is, a cooling apparatus for spraying hot steel plate hot rolled and transferred between pairs of constraining rolls with cooling water from pluralities of lines of spray nozzles so as to cool the same, which apparatus has lines of gentle cooling spray nozzles and lines of strong cooling spray nozzles with different orifice shapes and enables continuous control of the cooling ability over a broad range due to the fact that a maximum cooling water impact pressure integrated value of the lines of gentle cooling spray nozzles and a minimum cooling water impact pressure integrated value of the lines of strong cooling spray nozzles are continuous.

2 Claims, 10 Drawing Sheets

Fig.3

| | | FLOW RATE | NOZZLE LOAD PRESSURE | SPRAY RANGE | COOLING WATER IMPACT PRESSURE JUST BENEATH NOZZLE |
|---|---|---|---|---|---|
| | NOZZLE TYPE | [l/min] | [MPa] | [mm×mm] | [MPa] |
| A | OVAL 1 | 100 | 0.3 | 300×40=12000 | 0.0052 |
| B | OVAL 2 | 65 | 0.125 | 350×50=17500 | 0.0019 |
| C | OVAL 2 | 100 | 0.3 | 350×50=17500 | 0.0026 |
| D | OVAL 3 | 33 | 0.3 | 250×70=17500 | 0.0021 |
| E | OVAL 4 | 65 | 0.5 | 250×60=15000 | 0.0069 |
| F | OVAL 4 | 50 | 0.3 | 250×60=15000 | 0.0053 |
| G | OVAL 5 | 100 | 0.3 | 250×60=15000 | 0.0013 |
| H | FULL CONE | 100 | 0.3 | $\phi$70=3850 | 0.0077 |

(a)

OVAL NOZZLE (b)

FULL CONE NOZZLE

HEAT TRANSFER COEFFICIENT AT SURFACE TEMPERATURE OF 300°C

COOLING APPARATUS OF HOT STEEL PLATE, COOLING METHOD OF HOT STEEL PLATE, AND PROGRAM

BACKGROUND OF THE INVENTION

1. Field of the Invention

The present invention relates to an apparatus for controlled cooling of hot steel plate obtained by hot rolling while horizontally conveying the plate constrained by constraining rolls, more particularly relates to a cooling apparatus of hot steel plate enabling continuous wide range control of the cooling ability, a cooling method of hot steel plate, and a program.

2. Description of the Related Art

In order to improve the mechanical properties, workability, and weldability of steel plate, for example the general practice has been to acceleratedly cool a steel material in a high temperature state immediately after hot rolling while conveying the plate on a rolling line so as to give a predetermined cooling history to the steel material. The required cooling ability differs according to the type, purpose, etc. of the steel material. Development of a cooling apparatus enabling selection of the range of control of the cooling ability with a good precision and in a broad range is demanded.

As a cooling apparatus able to control the cooling ability in a broad range, there is a cooling apparatus using two-fluid (air and water) nozzles. However, two-fluid nozzles have complex nozzle structures, so easily become clogged, therefore the production cost and maintenance cost of the apparatus become high. Further, pressure control of the air and/or water is complex and it is difficult to maintain the air/water ratio constant. The cooling ability changes according to this air/water ratio. In this way, the above-described cooling apparatus has the problem that sophisticated control and maintenance of equipment are necessary in order to accurately control the cooling ability.

On the other hand, when using spray nozzles, the cooling ability can be controlled by adjusting the nozzle water amounts, but if the nozzle load pressures become small, it becomes impossible to secure a variety of spray patterns, therefore the range of control of the cooling ability becomes narrower in comparison with the case of using two-fluid nozzles.

Further, as a method of controlling the cooling ability, Japanese Patent Publication (A) No. 10-216821 shows a method of dividing the cooling apparatus into a plurality of cooling blocks in a transfer direction of the steel plate and controlling the supply of cooling water to each cooling block to turn on/off in units of individual cooling blocks or units of pluralities of cooling blocks. In this case, however, in a cooling block where the supply of the cooling water is turned on, the cooling rate near the steel material surface instantaneously becomes very large, therefore the hardness near the surface rises and, according to the type of the steel material, the required elongation of the steel material can no longer be secured.

Further, Japanese Patent Publication (A) No. 10-291019 shows a method of controlling the cooling ability, in a cooling apparatus cooling steel plate by running cooling water along its longitudinal direction, by moving the point where the cooling water contacts the steel plate along the longitudinal direction of the steel plate so as to change a contact length of the cooling water and the steel plate. However, this is a method of spraying a gas into a space between the steel plate and the cooling water to move the contact point, therefore, since a gas has a smaller density in comparison with the water, a very large flow rate is needed, so the running cost becomes high.

As a method of controlling the cooling ability of steel shapes, Japanese Patent Publication (A) No. 7-157826 shows a method of controlling the cooling performance over a broad range by adjusting the spray pitch of cooling water from cooling water nozzles aligned in the steel material conveyance direction, but in this case as well, a pitch adjustment mechanism of the cooling water nozzles becomes necessary, therefore there is a problem that the production cost and maintenance cost of the cooling apparatus become high.

SUMMARY OF THE INVENTION

The present invention was made to solve the above problems, relates to an apparatus for controlled cooling hot steel plate while constraining and conveying the plate by constraining rolls horizontally, and has as an object thereof to propose an inexpensive cooling apparatus of hot steel plate, a cooling method of the hot steel plate, and a program enabling continuous control of the cooling ability over a broad range.

A cooling apparatus of the present invention is a cooling apparatus of hot steel plate provided with a plurality of pairs of constraining rolls for constraining and conveying hot steel plate horizontally and spraying the top and bottom surfaces of the hot steel plate between adjoining pairs of constraining rolls with cooling water from respective pluralities of lines of spray nozzles so as to cool the hot steel plate, said cooling apparatus of hot steel plate characterized by having lines of gentle cooling spray nozzles each having a small cooling water impact pressure integrated value, defined as the value of the n power of the cooling water impact pressure integrated between a pair of constraining rolls in the conveyance direction, and lines of strong cooling spray nozzles each having a large cooling water impact pressure integrated value and by making the maximum cooling water impact pressure integrated value of said lines of gentle cooling spray nozzles and the minimum cooling water impact pressure integrated value of said lines of strong cooling spray nozzles equal and connecting the fluctuation regions of cooling water impact pressure integrated values of the two types of lines of spray nozzles, where, $0.05 \leqq n \leqq 0.2$.

Further, a line of strong cooling spray nozzles may be arranged at the hot steel plate entry side between pairs of constraining rolls.

Further, the maximum cooling water impact pressure integrated value of said lines of strong cooling spray nozzles and the minimum cooling water impact pressure integrated value when simultaneously using said lines of gentle cooling spray nozzles and said lines of strong cooling spray nozzles may be made equal.

According to the present invention from a different aspect, there is provided a cooling method constraining and conveying hot steel plate horizontally by a plurality of pairs of constraining rolls and spraying the top and bottom surfaces of the hot steel plate between adjoining pairs of constraining rolls with cooling water from respective pluralities of lines of spray nozzles so as to cool the hot steel plate, a cooling apparatus for working this cooling method characterized by having lines of gentle cooling spray nozzles each having a small cooling water impact pressure integrated value, defined as the value of the n power of the cooling water impact pressure integrated between a pair of constraining rolls in the conveyance direction, and lines of strong cooling spray nozzles each having a large cooling water impact pressure integrated value and by making the maximum cooling water impact pressure integrated value of said lines of gentle cooling spray nozzles and the minimum cooling water impact pressure integrated value of said lines of strong cooling spray nozzles equal and connecting the fluctuation regions of cooling water impact pressure integrated values of the two types of lines of spray nozzles, where, $0.05 \leqq n \leqq 0.2$.

Further, according to the present invention from a different aspect, there is provided a program for making a computer realize the above cooling method of the steel plate.

BRIEF DESCRIPTION OF THE DRAWINGS

These and other objects and features of the present invention will become clearer from the following description of the preferred embodiments given with reference to the attached drawings, wherein:

FIG. 3 is a table showing amounts of water, nozzle load pressures, spray ranges, and cooling water impact pressures of eight types of nozzles;

DESCRIPTION OF THE PREFERRED EMBODIMENTS

According to the present invention, there is provided a cooling apparatus of hot steel plate provided with a plurality of pairs of constraining rolls for constraining and conveying hot steel plate horizontally and spraying the top and bottom surfaces of the hot steel plate between the pairs of constraining rolls with cooling water from a plurality of lines of spray nozzles to cool the hot steel plate, said cooling apparatus arranging lines of gentle cooling spray nozzles and lines of strong cooling spray nozzles and selecting nozzle orifice shapes so that a maximum cooling water impact pressure integrated value of the lines of gentle cooling spray nozzles and a minimum cooling water impact pressure integrated value of the lines of strong cooling spray nozzles are continuous, whereby an inexpensive apparatus enabling control of the cooling ability over a broad range becomes possible.

The invention will be explained in further detail below. First, the results of research and development experiments conduced by the inventors for investigating and studying the factors contributing to the cooling in spray cooling will be explained according to the drawings.

Figure 1:
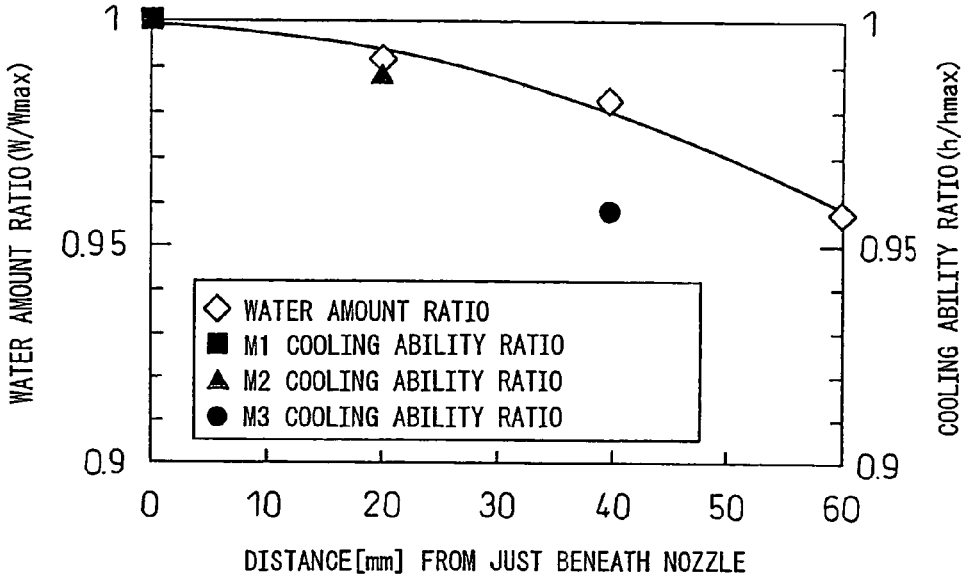
FIG. 1 is a graph showing the relationship between an amount of water and a cooling ability in a spray region of a nozzle.

If investigating the cooling ability distribution in a spray area in the case of cooling a cooled medium at rest by a single nozzle, as shown in FIG. 1, it was clarified that a difference of cooling ability of 4% or more occurs even at a position where the difference in the amount of water in the spray range of a single nozzle is 2% or less. That is, in the case of spray cooling, it is thought that the factors contributing to the cooling ability are not only the amount of water, but a variety of factors such as the droplet speed, droplet diameter, and droplet impact angle upon the cooled body all complexly interacting.

Figure 2:
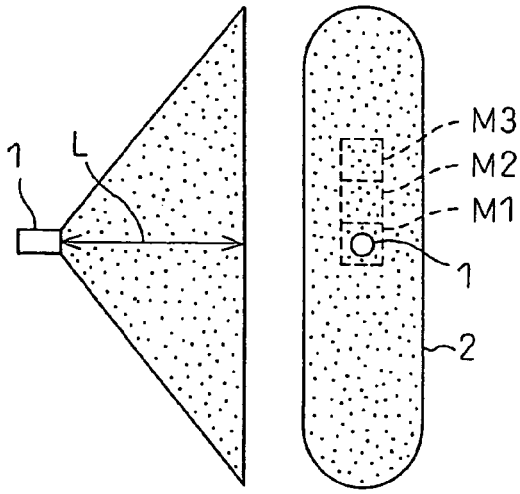
FIG. 2 is an explanatory view showing a nozzle and its spray region.

FIG. 1 shows the results obtained by measuring the average values of the amounts of water and cooling abilities within 20 mm×20 mm ranges M1, M2, and M3 when spraying cooling water to a range of 300 mm×40 mm (spray zone 2) from an oval nozzle (spray nozzle 1) arranged at a location of a distance L from a cooled surface shown in FIG. 2 of 150 mm and having a flow rate of 100 liters/min and a nozzle load pressure of 0.3 MPa and dividing these values by the maximum value of the measurement values to render them dimensionless (normalize them). Note that for the cooling ability, a cooling test was carried out by using a general structural use rolled steel material (SS400) having a plate thickness of 20 mm heated to 900° C. as the cooled body. The heat transfer coefficient measured at the time when the steel material surface temperature was 300° C. was used for evaluation as the cooling ability.

The present inventors discovered that the cooling factor able to comprehensively express the variety of these cooling factors including the amounts of water is the impact pressure of the cooling water.

Figure 4:
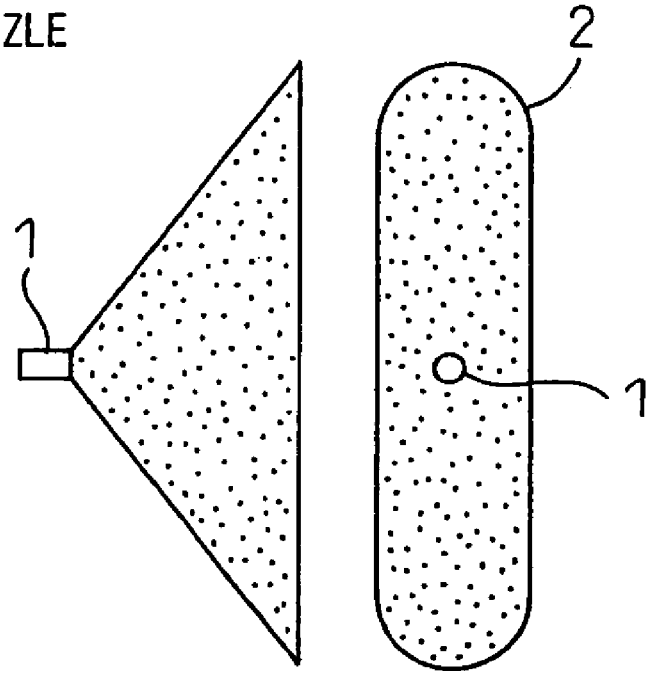
FIG. 4(*a*) is an explanatory view showing the spray region of an oval nozzle, and (*b*) is an explanatory view showing the spray region of a full cone nozzle.
Figure 4:
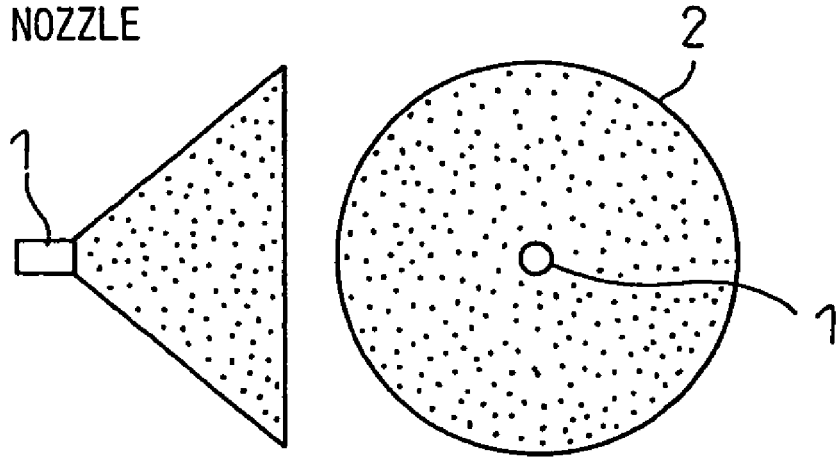
Figure 5:
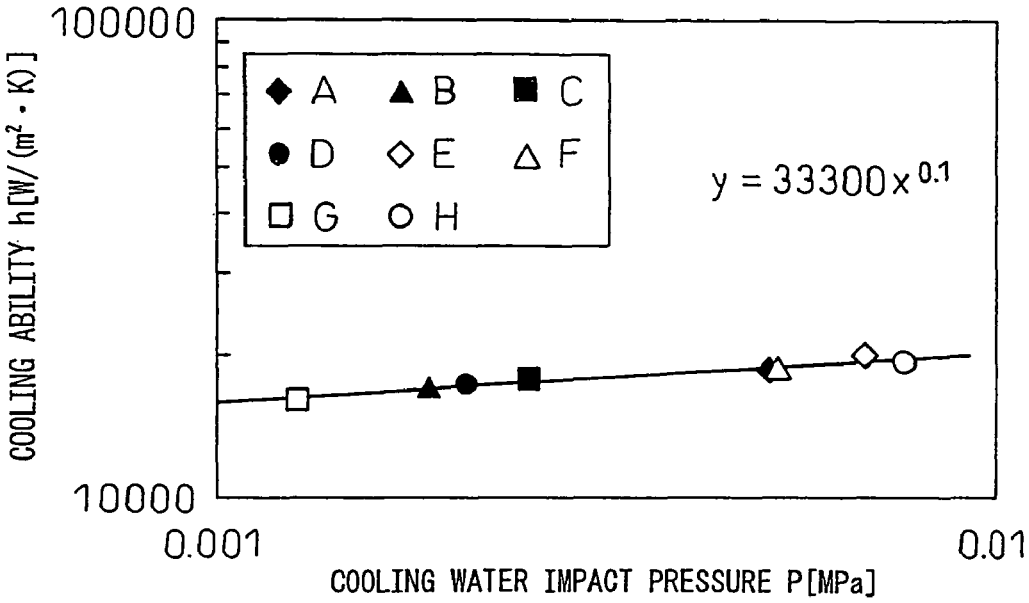
FIG. 5 is a graph showing relationships between cooling water impact pressures and cooling abilities for the eight types of nozzles in FIG. 3.

The present inventors investigated the relationships of the cooling water impact pressures on just below the nozzles and the cooling abilities by using eight types (A to H) of nozzles having different amounts of water, nozzle load pressures, and spray zones shown in the table of FIG. 3. Note that, as shown in FIG. 4, an oval nozzle 1 is one having a spray zone 2 becoming an oblong shape long in one direction, and a full cone nozzle 1 is one having a spray zone 2 becoming a circular shape. As a result, as shown in FIG. 5, irrespective of the type, specifications, and spray zone of the nozzle, there is a constant relationship between the cooling water impact pressures and cooling abilities. The following equation (1) can be derived. By entering the cooling water impact pressure P [MPa] into that equation (1), the heat transfer coefficient h [W/m$^2$·K)] (cooling ability can be found.

$$h = 33300 \times P^{0.1} \tag{1}$$

This shows that the cooling ability can be predicted by measuring the cooling water impact pressure even in nozzles differing in nozzle type and specifications, that is, orifice shapes.

Further, in this test, it was found that the heat transfer coefficient is proportional to the 0.1 power of the cooling water impact pressure, but if considering measurement error etc., it is believed that the heat transfer coefficient is proportional to the n power of the cooling water impact pressure and it is believed that the value of n is within a range from 0.05 to 0.2.

Figure 6:
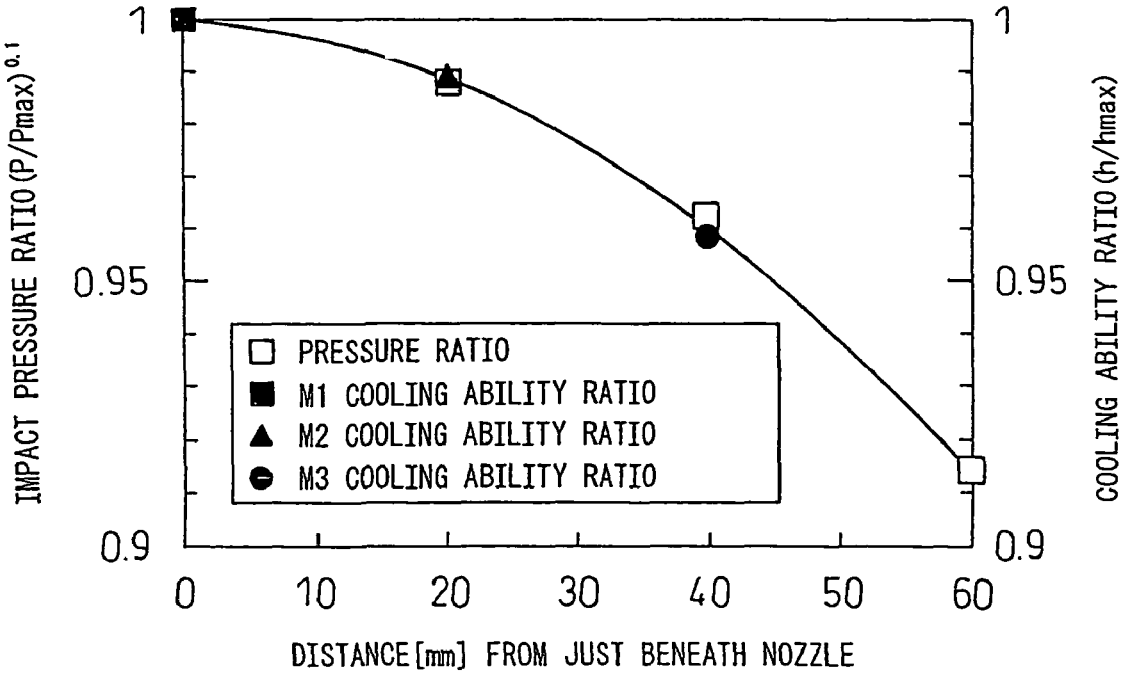
FIG. 6 is a graph showing the relationship between the cooling water impact pressure and the cooling ability in the spray region of a nozzle.

The values obtained by measuring the impact pressure distribution of the cooling water averaged in a range of 20 mm×20 mm for the same nozzle and same arrangement as those used in FIG. 1 explained above (spray nozzle 1), dividing the same by the maximum value of the impact pressure measurement values to render the same dimensionless (normalize them), and obtaining the 0.1 power of the same and the cooling ability distribution are shown together in FIG. 6. In this way, the equation (1) can be applied at all different positions within a single nozzle spray range, and it is possible to predict the impact ability according to the impact pressure of the cooling water.

In the case of a cooling apparatus provided with a plurality of pairs of constraining rolls for constraining and conveying hot steel plate horizontally, the flow of the cooling water pooled on the top surface of the plate is blocked by the pairs of constraining rolls, therefore the minimum section for cooling control becomes the space between pairs of constraining rolls. Usually, by continuously changing the amount of cooling water fed in this section, continuous control of the cooling ability is made possible.

However, in the method of continuously changing the amount of cooling water fed to one type of nozzles, when reducing the amount of water supplied to the nozzles and the nozzle load pressure becomes small, a proper spray pattern cannot be secured and the cooling uniformity is degraded. For this reason, in practice, the nozzle load pressure becomes a range of about 0.04 MPa to 0.3 MPa. If expressing the range of adjustment of the flow rate by the ratio of the minimum amount of water and the maximum amount water, about 1:3 becomes the controllable range. At this time, if expressing the impact pressure of the cooling water by the ratio of the impact pressure at the minimum amount of water and the impact pressure at the maximum amount of water, it becomes about 1:10 to 1:20. Therefore, as the range of control of the cooling ability, when calculating the cooling ability ratio when for example the steel material surface temperature is 300° C. from the equation (1), about 1:1.5 becomes the limit.

Therefore, by using the equation (1) derived by the present inventors, a cooling apparatus provided with lines of two types of spray nozzles having different orifice shapes but having continuous cooling ability ranges and thereby having a broad cooling control range is proposed. Here, nozzles having a large cooling water impact pressure integrated value within the spray range when the nozzle load pressure is 0.3 MPa are defined as "strong cooling spray nozzles", and nozzles having a small cooling water impact pressure integrated value are defined as "gentle cooling spray nozzles". Further, the cooling water impact pressure integrated value is the value of the n power of the cooling water impact pressure integrated between pairs of constraining rolls in the conveyance direction. The unit becomes $[MPa]^{n}\cdot m$ ($0.05 \leqq n \leqq 0.2$).

Further, by arranging lines of strong cooling spray nozzles at the hot steel plate entry side between the pairs of constraining rolls, in comparison with the case of arranging lines of gentle cooling spray nozzles at the hot steel plate entry side between the pairs of constraining rolls, the cooling uniformity in the direction perpendicular to conveyance is improved. The reason for this is considered to be the fact that the cooling time of a film boiling region easily causing uneven cooling can be shortened by strong cooling immediately after the start of the cooling.

A cooling apparatus 10 according to the present invention will be explained in brief by using FIGS. 7 to 11.

Figure 7:
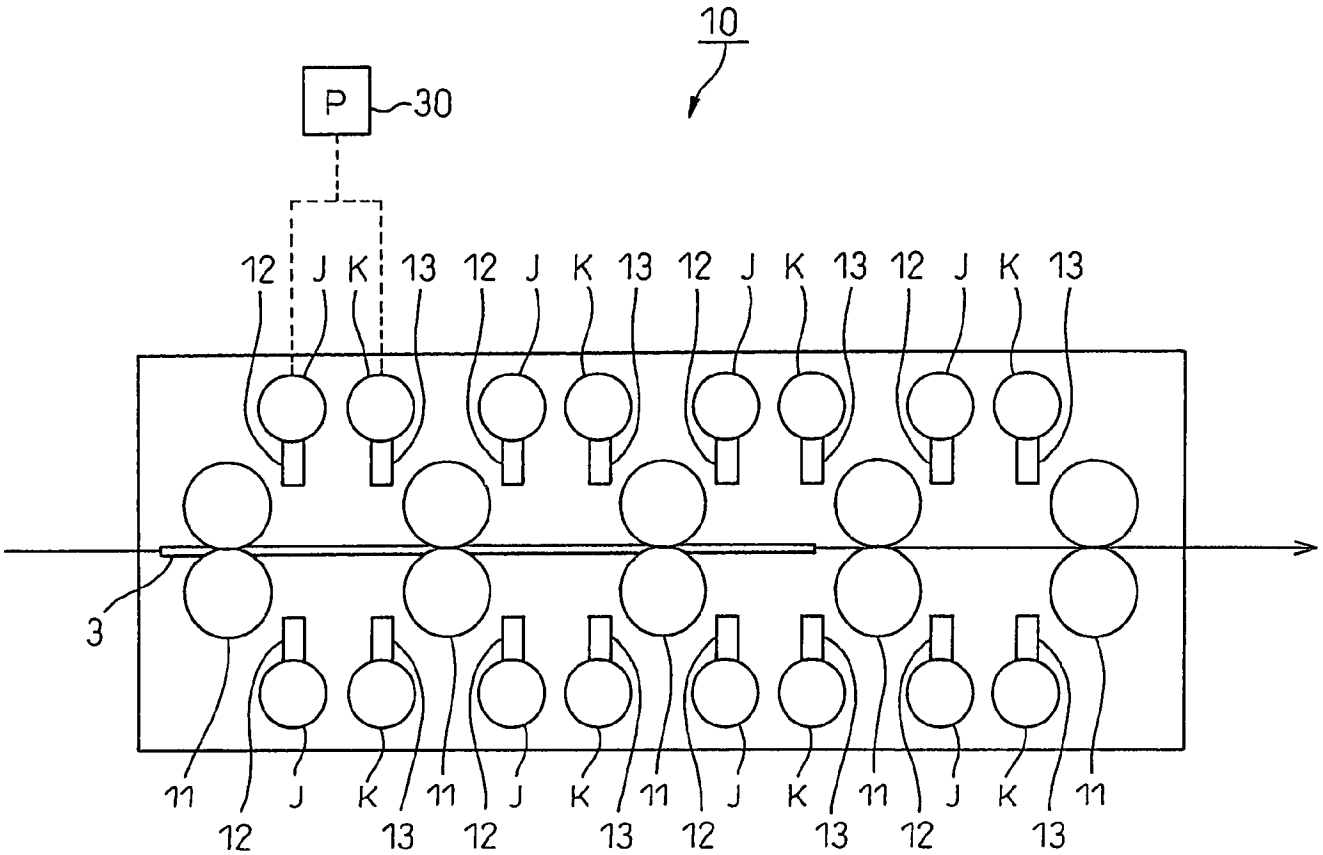
FIG. 7 is an explanatory view showing an outline of the constitution of a cooling apparatus according to the present invention.
Figure 8:
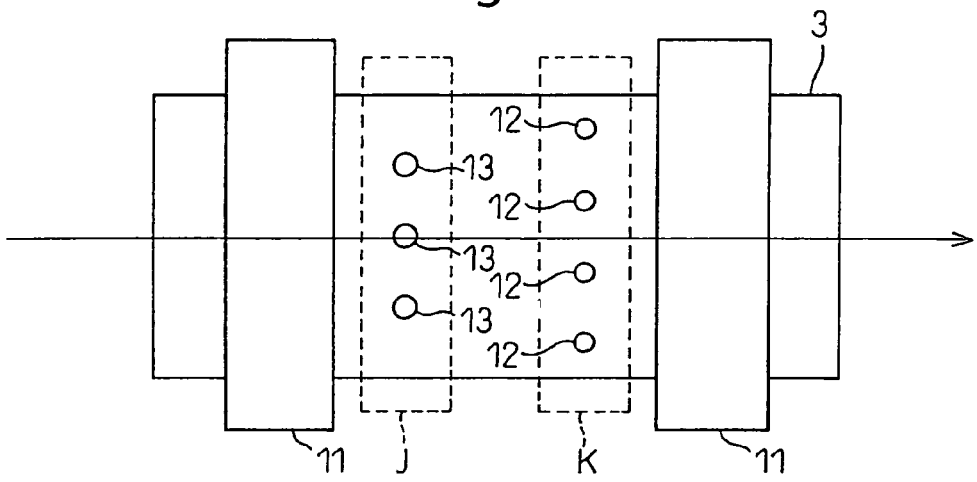
FIG. 8 is a plan view showing an arrangement of nozzles between pairs of constraining rolls of the cooling apparatus.

The cooling apparatus 10, for example as shown in FIG. 7, is provided with a plurality of pairs of constraining rolls 11 arranged in a horizontal direction along the conveyance direction of a hot steel plate 3. Each pair of constraining rolls 11 is comprised of two constraining rolls arranged at the top and bottom. The hot steel plate 3 is conveyed in a state sandwiched between these top and bottom constraining rolls. Between adjoining pairs of constraining rolls 11, lines J of strong cooling spray nozzles each comprised of a plurality of strong cooling spray nozzles 12 and lines K of gentle cooling spray nozzles each comprised of a plurality of gentle cooling spray nozzles 13 are arranged in parallel in this sequence toward the conveyance direction. The lines J of strong cooling spray nozzles and the lines K of gentle cooling spray nozzles are arranged at the top and bottom so as to sandwich the hot steel plate 3 on the conveyance path and can spray cooling water to the top and bottom surfaces of the hot steel plate 3. Further, the strong cooling spray nozzles 12 and gentle cooling spray nozzles 13 are arranged in lines in the width direction perpendicular to the conveyance direction as shown in FIG. 8. Note that the lines of strong cooling spray nozzles 12 and gentle cooling spray nozzles 13 are not limited to single lines and may be a plurality of lines.

Figure 9:
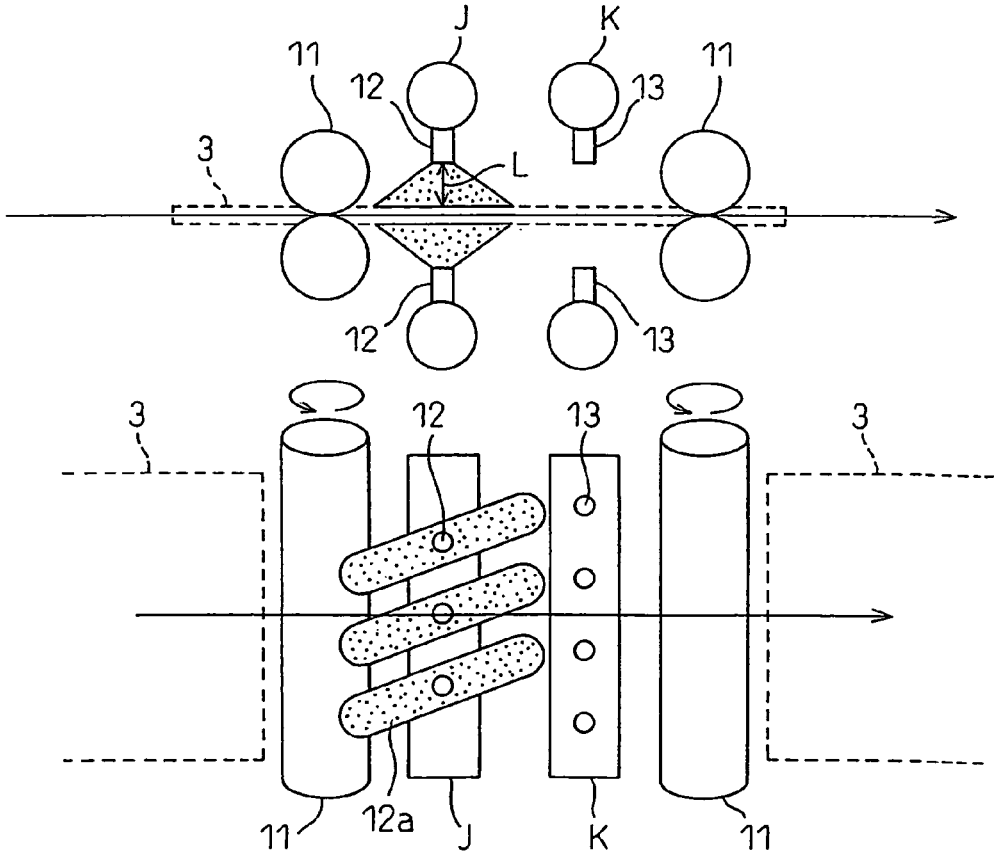
FIG. 9 is an explanatory view of a cooling apparatus in a case of using only lines of gentle cooling spray nozzles.
Figure 10:
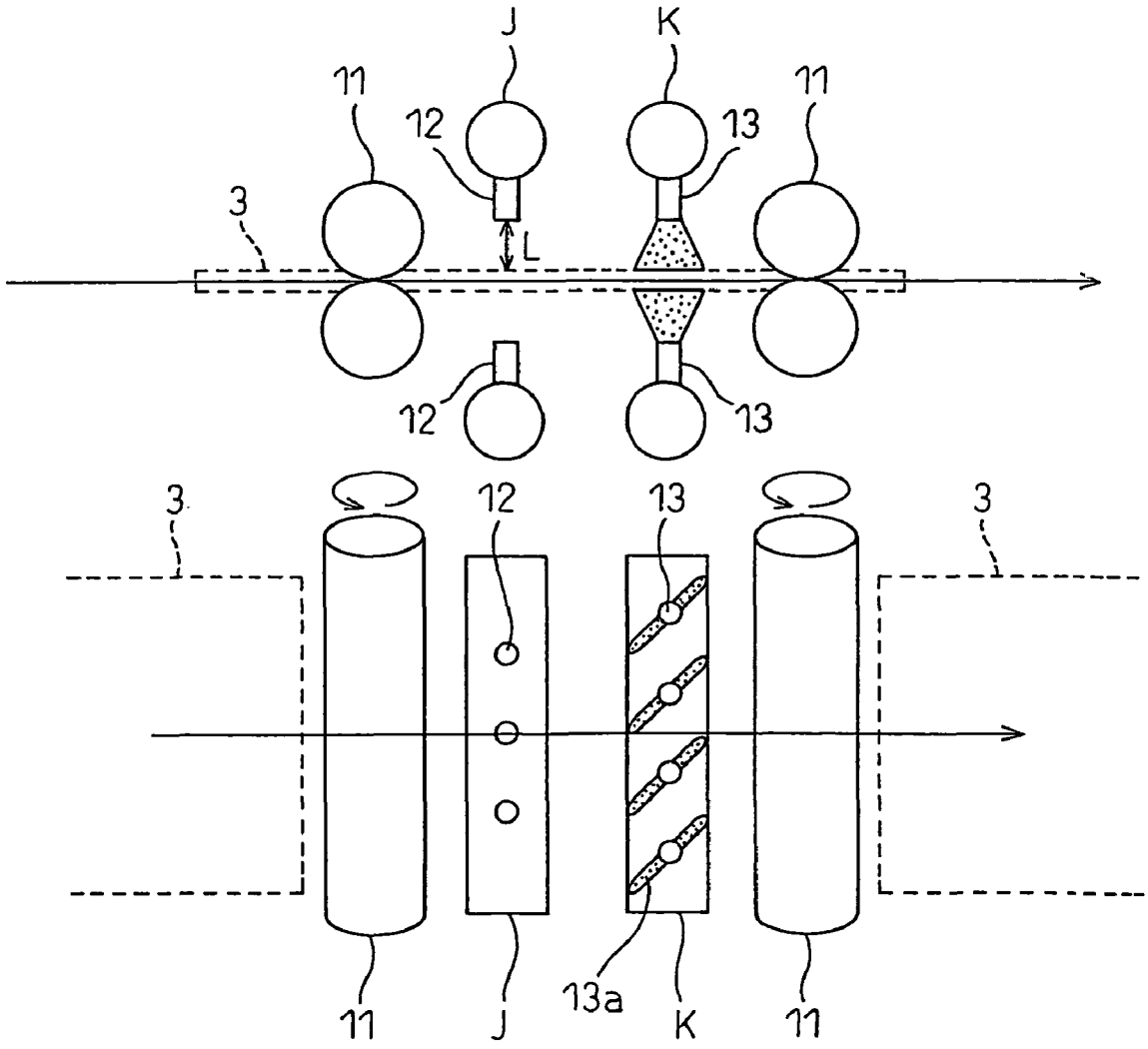
FIG. 10 is an explanatory view of a cooling apparatus in a case of using only lines of strong cooling spray nozzles.
Figure 11:
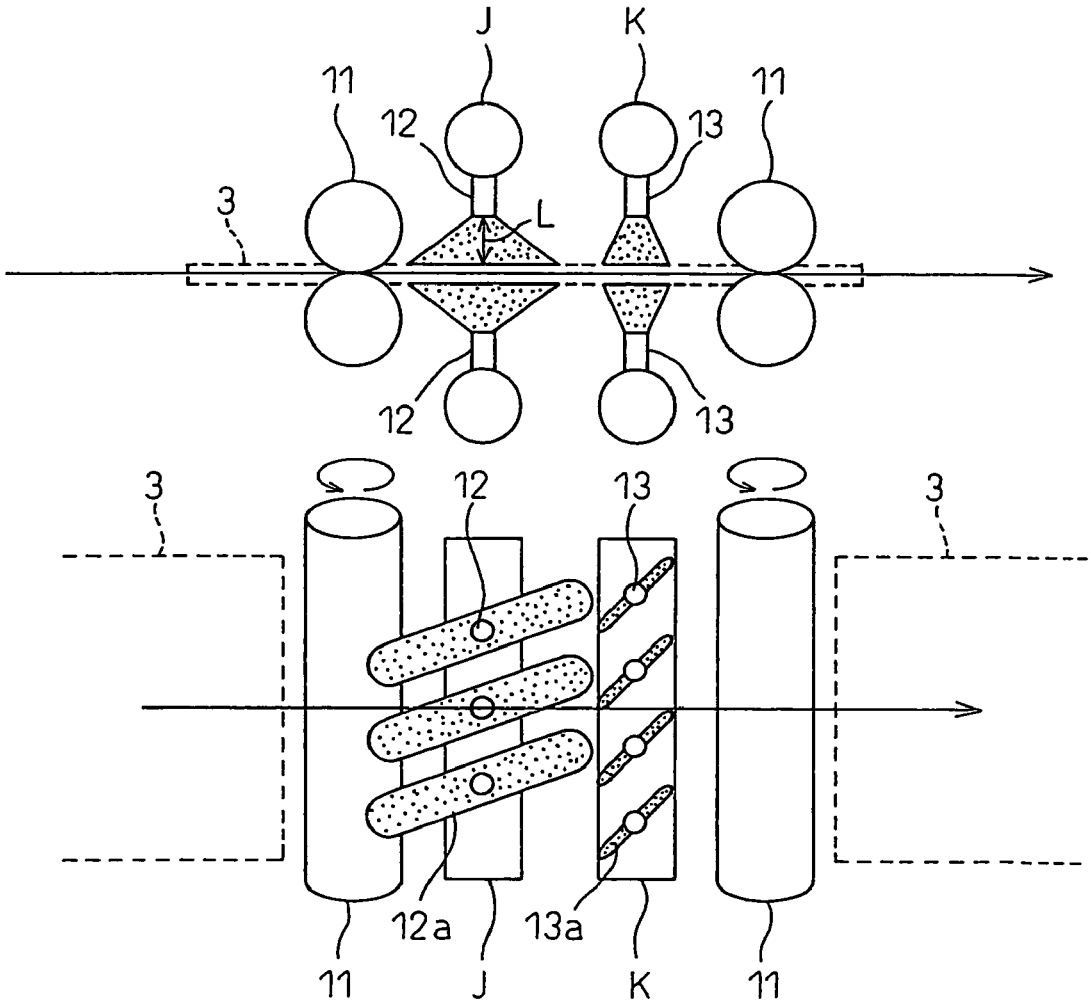
FIG. 11 is an explanatory view of a cooling apparatus in a case of simultaneously using lines of gentle cooling spray nozzles and lines of strong cooling spray nozzles.

FIG. 9 is an explanatory view showing a state where only the lines J of strong cooling spray nozzles spray cooling water between adjoining pairs of constraining rolls 11 of the cooling apparatus 10, FIG. 10 is an explanatory view showing a state where only lines K of gentle cooling spray nozzles inject cooling water, and FIG. 11 is an explanatory view showing a state where lines K of gentle cooling spray nozzles and lines J of strong cooling spray nozzles simultaneously spray cooling water. In order to maintain cooling uniformity in the width direction of the hot steel plate 3, nozzles 12 and 13 are arranged so that the conveyance direction integrated values of the cooling water spray impact pressures in the lines J and K become uniform in the width direction. Note that, in FIG. 9 to FIG. 11, strong cooling spray zones where the cooling water sprayed from the strong cooling spray nozzles 12 strikes the hot steel plate 3 will be indicated by 12*a*, and gentle cooling spray zones where the cooling water sprayed from the gentle cooling spray nozzles 13 strikes the hot steel plate 3 will be indicated by 13*a*.

Figure 12:
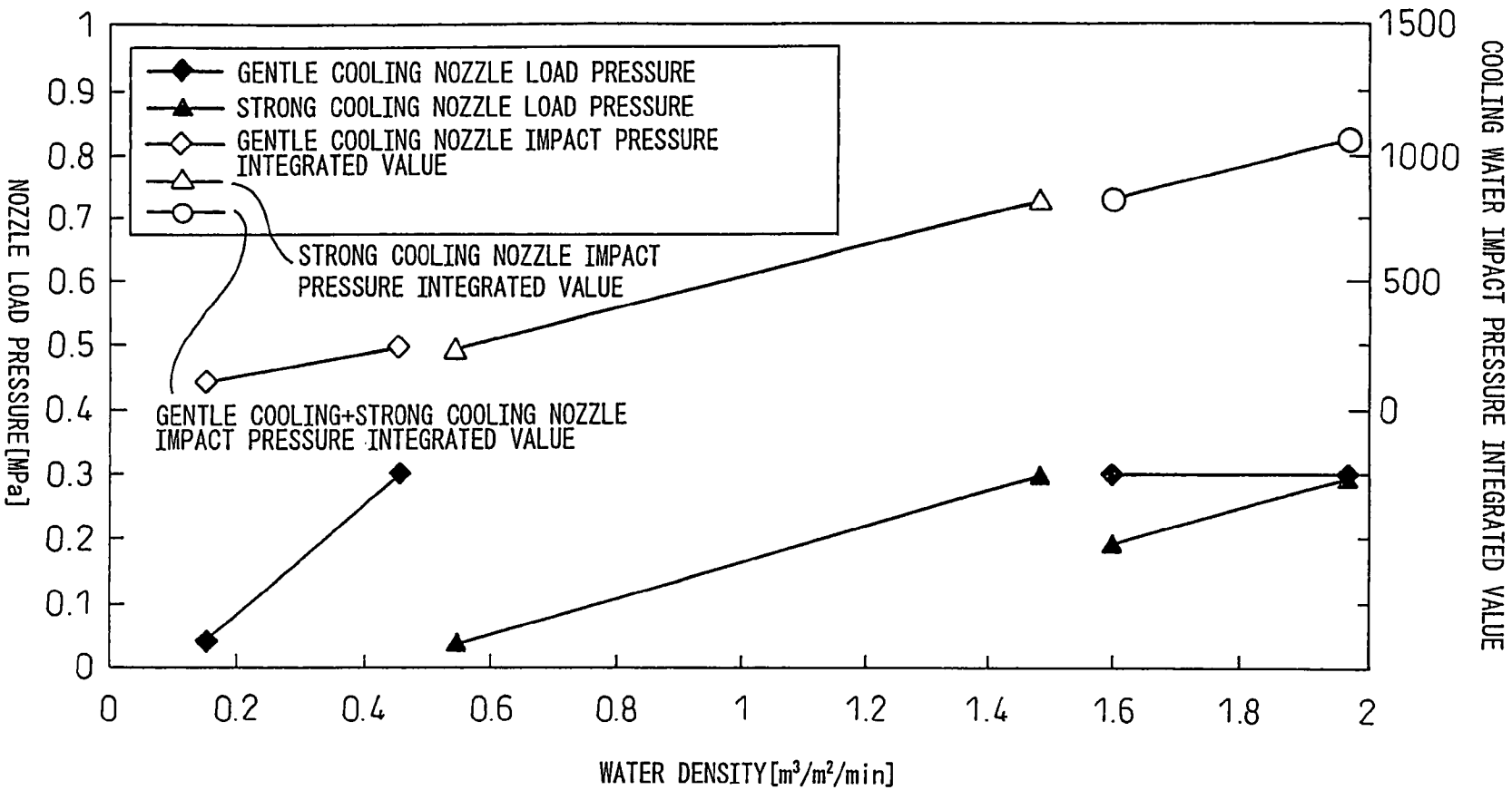
FIG. 12 is a graph showing the relationships of the water density, nozzle load pressure, and cooling water impact pressure integrated value.

The nozzles 12 and 13 of the lines J of strong cooling spray nozzles and the lines K of gentle cooling spray nozzles are used within the nozzle load pressure range set from the cooling water feed pump capacity as shown in FIG. 12. Further, the nozzles 12 and 13 are selected so that the cooling water impact pressure integrated value of all lines K of gentle cooling spray nozzles at the maximum value of the nozzle load pressure range of the lines of gentle cooling spray nozzles 13 (the maximum cooling water impact pressure integrated value of the lines K of gentle cooling spray nozzles) and the cooling water impact pressure integrated value of all lines J of strong cooling spray nozzles at the minimum value of the nozzle load pressure range of the lines of strong cooling spray nozzles 12 (the minimum cooling water impact pressure integrated value of the lines J of strong cooling spray nozzles) become the same. Due to this, the regions of fluctuation of the cooling water impact pressure integrated values of the lines K of gentle cooling spray nozzles and the lines J of strong cooling spray nozzles can be made continuous and as result a continuous range of control of the cooling ability can be obtained in the case where gentle cooling spray nozzles 13 are used and the case where strong cooling spray nozzles 12 are used.

Further, the lower limit of the cooling water impact pressure integrated value of all of the spray nozzle lines K and J in the case where the strong cooling spray nozzles 12 and the gentle cooling spray nozzles 13 simultaneously spray water is set to become equal to the cooling water impact pressure integrated value of the lines J of strong cooling spray nozzles at the maximum value of the nozzle load pressure range of the strong cooling spray nozzles 12 (the maximum cooling water impact pressure integrated value of the lines J of strong cooling spray nozzles). Due to this, a continuous range of control of the cooling ability can be obtained in the case where cooling water is simultaneously sprayed by using the strong cooling spray nozzles 12 and gentle cooling spray nozzles 13 and in the case where cooling water is sprayed by using only the strong cooling spray nozzles 12. Note that the minimum cooling water impact pressure integrated value of all of the spray nozzle lines K and J in the case where the strong cooling spray nozzles 12 and gentle cooling spray nozzles 13 are made to simultaneously spray water is set to become equal with the maximum cooling water impact pressure integrated value of the lines J of strong cooling spray nozzles by for example a control unit 30 (shown in FIG. 7) for controlling the cooling water impact pressures of the spray nozzles 12 and 13 (shown in FIG. 7). For example, the control unit 30 is a computer which has a program storage portion and runs a program P stored in that program storage portion to set the above-described cooling water impact pressure integrated value. Note that, in FIG. 7, the control unit 30 is shown connected to the lines K and J of spray nozzles in the portion shown by the broken lines for convenience, but the cooling water impact pressures of all spray nozzles 12 and 13 can be controlled.

In FIG. 12, the gentle cooling spray nozzles 13 were set at the maximum nozzle load pressure and the strong cooling spray nozzles 12 were adjusted to set the lower limit of the cooling water impact pressure integrated values of all of the spray nozzle lines K and J in the case where the strong cooling spray nozzles 12 and gentle cooling spray nozzles 13 are simultaneously used so as to become equal to the maximum cooling water impact pressure integrated value of the lines J of strong cooling spray nozzles. When the cooling ability (heat transfer coefficient) is raised to more than this lower limit, the strong cooling spray nozzles 12 are adjusted by the value above the lower limit since the gentle cooling spray nozzles 13 are set to the maximum nozzle load pressure.

What is important here is that the range of cooling ability of the lines K of gentle cooling spray nozzles, the range of cooling ability of the lines J of strong cooling spray nozzles, and the range of cooling ability when simultaneously using lines J of strong cooling spray nozzles and lines K of gentle cooling spray nozzles are continuous. The ranges of water amounts used do not necessarily also have to be continuous. As an example of portions where the amounts of water used are discontinuous, in FIG. 12, there are portions where the water densities become discontinuous in the portions of 0.5 and 1.5.

If expressing the range of adjustment of the flow rate when applying this invention by the ratio of the minimum water amount and the maximum water amount, the range of control becomes 1:3 for the gentle cooling spray nozzles 13 and strong cooling spray nozzles 12, therefore the overall range of adjustment of the flow rate becomes 1:9 to 1:10 or a range equivalent to that of the aforesaid case of two-fluid sprays. Further, as the range of control of the cooling ability when applying this invention, by selecting nozzles having different spray ranges, the cooling area can be added as a cooling ability control factor, therefore the range of control of the cooling ability becomes a wide range of about 1:3 to 1:5

Above, preferred embodiments of the present invention were explained with reference to the attached drawings, but the present invention is not limited to such examples. It is clear that a person skilled in the art could arrive at various changes or modifications in the scope of the ideas described in the claims.

EXAMPLES

Figure 13:
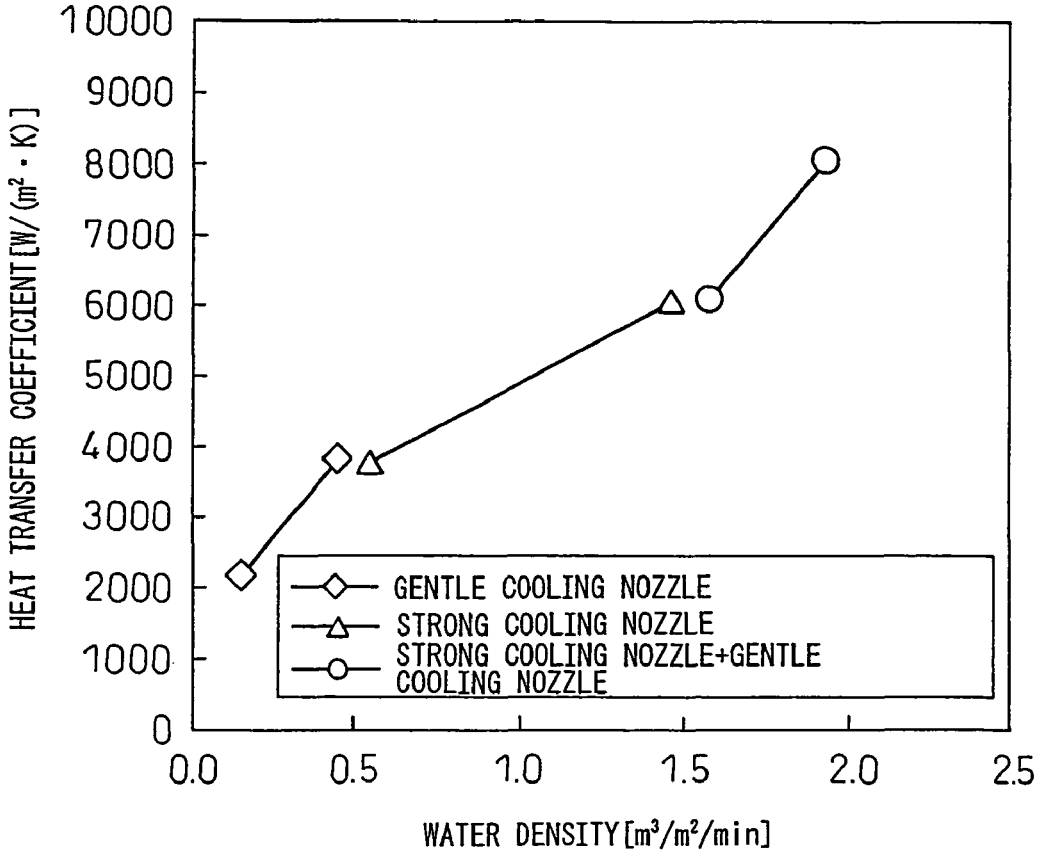
FIG. 13 is a graph showing the relationship between the cooling water density and the heat transfer coefficient when the steel material surface temperature is 300° C.

FIG. 13 shows the range of control of the cooling ability measured by running a plate conveyance and cooling test by the cooling apparatus 10 of the present invention. As a test piece, use was made of a general structural use rolled steel material (SS400) having a thickness of 20 mm, a width of 300 mm, and a length of 200 mm provided with a thermocouple at a 1 mm depth position from the cooling surface at the center of the test piece. This was conveyed and cooled from about 900° C. to 100° C., the heat transfer coefficient was calculated from the temperature history, and the plate was evaluated by the heat transfer coefficient at different water densities at the time when the surface temperature was 300° C.

As clear from FIG. 13, the ranges of control of the cooling ability of the gentle cooling spray nozzles 13 and strong cooling spray nozzles 12 are continuous. Further, the range of control of the cooling ability of the strong cooling spray nozzles 12 and the range of control of the cooling ability at the time when simultaneously using the gentle cooling spray nozzles 13 and strong cooling spray nozzles 12 are continuous. The overall range of control of the cooling ability is a broad range of 1:4.

The present invention is useful when enabling inexpensive and continuous control of the cooling ability over a broad range in an apparatus for controlled cooling of hot steel plate while constraining and conveying the plate by constraining rolls horizontally.

The invention claimed is:

1. A cooling method comprising constraining and conveying hot steel plate horizontally by a plurality of pairs of constraining rolls and spraying the top and bottom surfaces of the hot steel plate between adjoining pairs of constraining rolls with cooling water from respective pluralities of lines of spray nozzles so as to cool the hot steel plate, wherein said plurality of lines of spray nozzles between an adjoining pair of constraining rolls comprises one or more lines of a first type of spray nozzles each having a first range of cooling water impact pressure integrated value, wherein each said line of first type of spray nozzles is arranged in the width direction perpendicular to the conveyance direction, and one or more lines of a second type of cooling spray nozzles each having a second range of cooling water impact pressure integrated value which is higher than said first range of cooling water impact pressure integrated value, wherein each said line of second type of spray nozzles is arranged in the width direction perpendicular to the conveyance direction, said cooling water impact pressure integrated value being defined as the value of the n power of the cooling water impact pressure integrated in the steel plate conveyance direction between a pair of constraining rolls, where $0.05 \leqq n \leqq 0.2$;

wherein said first type and second type of spray nozzles are selected such that the maximum of said first range of cooling water impact pressure integrated value and the minimum of said second range of cooling water impact pressure integrated value are equal; and wherein said first type and second type of spray nozzles are arranged such that regions of fluctuation of cooling water impact pressure integrated values of the two types of lines of spray nozzles are continuous.

2. A cooling method as set forth in claim 1, wherein said first type and second type of spray nozzles are set such that when simultaneously using said lines of said first type of spray nozzles and said lines of said second type of spray nozzles, the minimum of the total cooling water impact pressure integrated value of said first type of spray nozzles and said second type of spray nozzles arc made equal to the maximum of said second range of cooling water impact pressure integrated value.

* * * * *